US007306033B2

(12) United States Patent
Gorrara

(10) Patent No.: US 7,306,033 B2
(45) Date of Patent: Dec. 11, 2007

(54) APPARATUS FOR ISOLATING ZONES IN A WELL

(75) Inventor: Andrew John Gorrara, Stonehaven (GB)

(73) Assignee: Read Well Services Limited, Aberdeen (GB)

( * ) Notice: Subject to any disclaimer, the term of this patent is extended or adjusted under 35 U.S.C. 154(b) by 223 days.

(21) Appl. No.: 11/197,683

(22) Filed: Aug. 4, 2005

(65) Prior Publication Data

US 2006/0027371 A1 Feb. 9, 2006

(30) Foreign Application Priority Data

Aug. 4, 2004 (GB) ..... 0417328.2

(51) Int. Cl.
*E21B 33/127* (2006.01)

(52) U.S. Cl. ..... 166/187; 166/191; 166/387; 277/331; 277/334

(58) Field of Classification Search ..... 166/387, 166/187, 191, 195; 277/331, 333, 334
See application file for complete search history.

(56) References Cited

U.S. PATENT DOCUMENTS

| | | | | |
|---|---|---|---|---|
| 1,547,240 | A * | 7/1925 | Steele | 166/264 |
| 2,922,478 | A * | 1/1960 | Maly | 166/154 |
| 3,460,625 | A | 8/1969 | Hart et al. | |
| RE30,711 | E * | 8/1981 | Suman, Jr. | 166/285 |
| 4,487,528 | A * | 12/1984 | Skogberg | 405/259.3 |
| 4,659,530 | A * | 4/1987 | Boyers et al. | 264/315 |
| 4,714,117 | A * | 12/1987 | Dech | 166/380 |
| 4,913,232 | A * | 4/1990 | Cheymol et al. | 166/285 |
| 5,190,109 | A | 3/1993 | Pardo | |
| 5,267,617 | A * | 12/1993 | Perricone et al. | 166/387 |
| 5,271,469 | A * | 12/1993 | Brooks et al. | 166/387 |
| 5,417,289 | A | 5/1995 | Carisella | |
| 6,513,601 | B1 | 2/2003 | Gunnarsson et al. | |
| 6,640,893 | B1 * | 11/2003 | Rummel et al. | 166/187 |
| 6,752,205 | B2 * | 6/2004 | Kutac et al. | 166/187 |

(Continued)

FOREIGN PATENT DOCUMENTS

EP 565323 A1 * 10/1993

(Continued)

OTHER PUBLICATIONS

Halliburton Materials, "Expansion Screen Completion Systems," T. Harley, handout from Society of Petroleum Engineers, 6 pages, Mar. 2004.

(Continued)

*Primary Examiner*—David Bagnell
*Assistant Examiner*—Shane Bomar
(74) *Attorney, Agent, or Firm*—Drinker Biddle & Reath LLP

(57) ABSTRACT

An apparatus and method, particularly useful for isolating zones in a hydrocarbon wellbore. The apparatus includes a tubular section, such as a length of casing or liner tubular, arranged to be run into and secured within the wellbore which may be open hole or already cased. At least one sleeve member is positioned on the exterior of the tubular section and is sealed thereto. A pressure control device, which typically consists of a pressurised hydraulic fluid delivery device, can be used to increase the pressure within the sleeve member to cause the sleeve member to move outwardly and bear against an inner wall of the wellbore.

11 Claims, 12 Drawing Sheets

U.S. PATENT DOCUMENTS

| | | | | |
|---|---|---|---|---|
| 6,854,522 | B2 * | 2/2005 | Brezinski et al. | 166/387 |
| 7,178,603 | B2 * | 2/2007 | Naquin et al. | 166/387 |
| 2002/0166672 | A1 * | 11/2002 | White et al. | 166/387 |
| 2003/0196795 | A1 * | 10/2003 | Kutac et al. | 166/187 |
| 2004/0055758 | A1 * | 3/2004 | Brezinski et al. | 166/384 |
| 2004/0055760 | A1 | 3/2004 | Nguyen | |
| 2004/0159445 | A1 * | 8/2004 | Hazel et al. | 166/382 |
| 2006/0042801 | A1 * | 3/2006 | Hackworth et al. | 166/387 |
| 2007/0056749 | A1 * | 3/2007 | Gambier et al. | 166/387 |

FOREIGN PATENT DOCUMENTS

| | | | |
|---|---|---|---|
| GB | 2262553 A | * | 6/1993 |
| GB | 2 398 312 | | 8/2004 |
| WO | WO 01/80650 | | 11/2001 |

OTHER PUBLICATIONS

Halliburton Materials, "Annular Barrier Tool Technology," pages 8; http://halliburton.com/esg/pdf/abtvr.pdf; (2005).

* cited by examiner

APPARATUS FOR ISOLATING ZONES IN A WELL

FIELD OF THE INVENTION

The present invention relates to apparatus and methods for securing a tubular within another tubular or borehole, isolating an annulus or centralising sections of pipe. In particular the invention has application for centralising and/or securing a casing tubular or liner tubular within another casing section, liner section or open borehole in an oil, gas or water well and for isolating a portion of a borehole located below the apparatus from a portion of the borehole located above the apparatus.

BACKGROUND OF THE INVENTION

Oil, gas or water wells are conventionally drilled with a drill string, which comprises drill pipe, drill collars and drill bit(s). The drilled open hole is hereinafter referred to as a "borehole". A borehole is typically provided with casing sections, liners and/or production tubing. The casing is usually cemented in place to prevent the borehole from collapse and is usually in the form of at least one large diameter pipe.

SUMMARY OF THE INVENTION

According to a first aspect of the present invention there is provided apparatus comprising:

a tubular section arranged to be run into and secured within a larger diameter generally cylindrical structure;

at least one sleeve member wherein the sleeve member is positioned on the exterior of the tubular section and sealed thereto; and pressure control means operable to alter the pressure within the sleeve member such that an increase in pressure causes the sleeve to move outwardly and bear against an inner surface of the larger diameter structure.

The large diameter structure may be an open hole borehole, a borehole lined with a casing or liner string which may be cemented in place downhole, or may be a pipeline within which another smaller diameter tubular section requires to be secured or centralised.

The tubular section is preferably located coaxially within the sleeve. Therefore the present invention allows a casing section or liner to be centralised within a borehole or another downhole underground or above ground pipe by provision of an expandable sleeve member positioned around the tubular section.

The tubular section can be used within a wellbore, run into an open or cased oil, gas or water well. The tubular section may be a part of a liner or casing string. In this context, the term "liner" refers to sections of casing string that do not extend to the top of the wellbore, but are anchored or suspended from the base region of a previous casing string. Sections of liner are typically used to extend further into a wellbore, reduce cost and allow flexibility in the design of the wellbore.

As previously stated casing sections are often cemented in place following their insertion into the borehole. Extension of the wellbore can be achieved by attaching a liner to the interior of a base portion of a casing section. Ideally the liner should be secured in position and this is conventionally achieved by cementing operations. However, cementing sections of liner in place is time consuming and expensive.

The present invention can be used as a means to centralise and secure such a liner section, thus removing the need for cementing.

Downhole embodiments of the apparatus can be used to isolate one section of the downhole annulus from another section of the downhole annulus and thus can also be used to isolate one or more sections of downhole annulus from the production conduit. The apparatus preferably comprises a means of securing the sleeve member against the exterior of the tubular member which may be a casing section or liner wall and preferably, the sleeve member provides a means of creating a reliable hydraulic seal to isolate the annulus, typically by means of an expandable metal element.

The sleeve member can be coupled to the casing section or liner by means of welding, clamping or other suitable means.

Preferably the apparatus is also provided with seal means. The function of the seal means is to provide a pressure tight seal between the exterior of the tubular section and the sleeve member, which may be the interior or one or both ends of the sleeve member.

The seal means can be mounted on the tubular section to seal the sleeve member against the exterior of the tubular section. A chamber is created, which chamber is defined by the outer surface of the tubular section, the inner surface of the sleeve member and an inner face of the seal means. The seal means may be annular seals which may be formed of an elastomer or any other suitable material.

The sleeve may be manufactured from metal which undergoes elastic and plastic deformation. The sleeve is preferably formed from a softer and/or more ductile material than that used for the casing section or liner. Suitable metals for manufacture of the sleeve member include certain types of steel. Further, the sleeve member may be provided with a coating such as an elastomeric coating. In addition the sleeve member may be provided with a non-uniform outer surface such as ribbed, grooved or other keyed surface in order to increase the effectiveness of the seal created by the sleeve member when secured within another casing section or borehole.

According to another aspect of the present invention, the pressure control means comprise a hydraulic tool equipped with at least one aperture. Additionally, the tubular section preferably comprises at least one port to permit the flow of fluid into and out of the chamber created by the sleeve member. In operation the hydraulic tool is capable of delivering fluid through the aperture of the hydraulic tool under pressure and through the at least one port in the tubular member into the chamber. The hydraulic tool may contain hydraulic or electrical systems to control the flow and/or pressure of said fluid.

The pressure control means may also be operable to monitor and control the pressure within the casing section. The pressure in the sleeve member is preferably increased between seal means and may be achieved by introduction of pressurised fluid.

Pressure within the sleeve member is preferably increased so that the sleeve member expands and contacts the outer casing or borehole wall, until sufficient contact pressure is achieved resulting in a pressure seal between the exterior of the sleeve member and the inner surface of the casing or borehole wall against which the sleeve member can bear. Ideally, this pressure seal should be sufficient to prevent or reduce flow of fluids from one side of the sleeve member to the other and/or provide a considerable centralisation force.

The initial outside diameter of the sleeve member can increase on expansion of the sleeve member to seal against the interior of the wellbore or other casing section.

The sleeve can be expanded by various means. According to one aspect of the invention, the tubular section is provided with at least one port formed through its sidewall and positioned between the seals of the sleeve member to allow fluid under pressure to travel therethrough from a throughbore of the tubular section into the chamber.

The port(s) may be provided with check valves or isolation valves which, on hydraulic expansion of the sleeve into its desired position, act to prevent flow of fluid from the chamber to the throughbore of the tubular section to preferably maintain the sleeve in its expanded configuration once the hydraulic tool is withdrawn. In this context, check valve or isolation valve is intended to refer to any valve which permits flow in only one direction. The check valve design can be tailored to specific fluid types and operating conditions.

Alternatively, the port(s) may be provided with a rupture-able barrier device, such as a burst disk device or the like, which prevents fluid flow through the port(s) until an operator intentionally ruptures the barrier device by, for example, applying hydraulic fluid pressure to the tubing side of the barrier device until the pressure is greater than the rated strength of the barrier device. The use of such optional barrier device can be advantageous if an operator wishes to keep well fluids out of the sleeve chamber until the sleeve is ready for expansion.

Another method of effecting expansion of the sleeve member involves insertion of a chemical fluid which can set to hold the sleeve member in place. An example of such fluid is cement.

Towards the end of each sleeve member, sliding seals between the interior of the sleeve member and exterior of the tubular casing may be provided. A sliding seal allows movement in a longitudinal direction to shorten the distance between the ends of the sleeve member such that outward movement of the sleeve does not cause excessive thinning of the sleeve member.

Expansion of the sleeve can be facilitated by provision of a sliding seal and/or through elastic and/or plastic deformation when the sleeve member yields. The sleeve member should preferably expand such that contact is effected between the exterior of the sleeve member and another pipe or borehole wall. In this way the at least one outer sleeve can be used to support or centralise the tubular member within an outer tubular member or borehole. The apparatus can also be used to isolate one part of annular space from another section of annular space. The outer sleeve members can be utilised to centralise one casing section within another or within an open hole well section.

There can be a plurality of sleeve members on a casing section to isolate separate zones and separate formations from one another. The plurality of sleeve members may be expanded individually, in groups or simultaneously. In a situation when it is desired that all sleeve members are expanded simultaneously, this can be achieved by increasing the pressure within the entire casing section. Expansion of individual sleeve members or groups of sleeve members can be achieved by plugging or sealing internally above and below the ports which communicate with the respective sleeve members to be expanded and the pressure between these seals can be increased to the desired level.

In preferred embodiments, the apparatus further comprises a sealant material provided on the outer surface of said sleeve and more preferably, the sealant material is provided with a protective covering layer or yet further outer sleeve member. Said further outer sleeve member may be unitary in fashion in order to seal the sealant material within a chamber defined between the inner surface of said further outer sleeve member and the outer surface of the aforementioned sleeve member. Alternatively, the yet further outer sleeve member may be provided with perforations or apertures therein to permit the sealant material to be extruded from said chamber when the said sleeve member is expanded radially outwardly in order to further enhance the seal provided by the apparatus.

In certain circumstances it is necessary to isolate portions of annular space from adjacent portions within a wellbore. The present invention also creates a reliable seal to isolate the annulus.

The apparatus has a dual function since it can be utilised with concentric tubulars such as pipelines to support or centralise the inner member inside an outer member and to isolate one part of annular space from another.

According to another aspect of the present invention, a casing section is provided with perforations. In this situation sleeve members may be located either side of a perforation in the casing section allowing fluid from the well to enter the casing through the perforation, with the expandable sleeve members acting as an impediment to prevent fluid from entering different annular zones.

The casing section or liner should be designed to withstand a variety of forces, such as collapse, burst, and tensile failure, as well as chemically aggressive brines. Casing sections may be fabricated with male threads at each end, and short-length couplings with female threads may be used to join the individual joints of casing together.

Alternatively the joints of casing may be fabricated with male threads on one end and female threads on the other. The casing section or liner is usually manufactured from plain carbon steel that is heat-treated to varying strengths, but other suitable materials include stainless steel, aluminium, titanium and fibreglass.

In accordance with the present invention there is also provided a method comprising the steps of:

sealing at least one expandable sleeve member on the exterior of a tubular section;

inserting the casing section into a generally cylindrical structure; and providing pressure control means operable to increase the pressure within the sleeve member, such that the pressure increase causes the sleeve member to move outwardly allowing the exterior surface of the sleeve member to bear against the inner surface of the generally cylindrical structure.

In certain preferred embodiments the method is useful for centralising one pipe within another or within an open hole well section. More preferably, the apparatus and method are useful in isolating a section of borehole located below the expandable sleeve member from a section of borehole located above the expandable sleeve member.

The above-described method comprises inserting the casing section into another section or borehole to the required depth. This may be by way of incorporating the casing section into a casing or liner string and running the casing/liner string into the other section or borehole.

Pressure, volume, depth and diameter of the sleeve member at a given time during expansion thereof can be recorded and monitored by either downhole instrumentation or surface instrumentation.

BRIEF DESCRIPTION OF THE DRAWINGS

Embodiments of the invention will now be described by way of example only and with reference to the accompanying drawings in which:

FIG. 6 shows a sequence for expanding two sleeve members;

DESCRIPTION OF PREFERRED EMBODIMENTS

Figure 1:
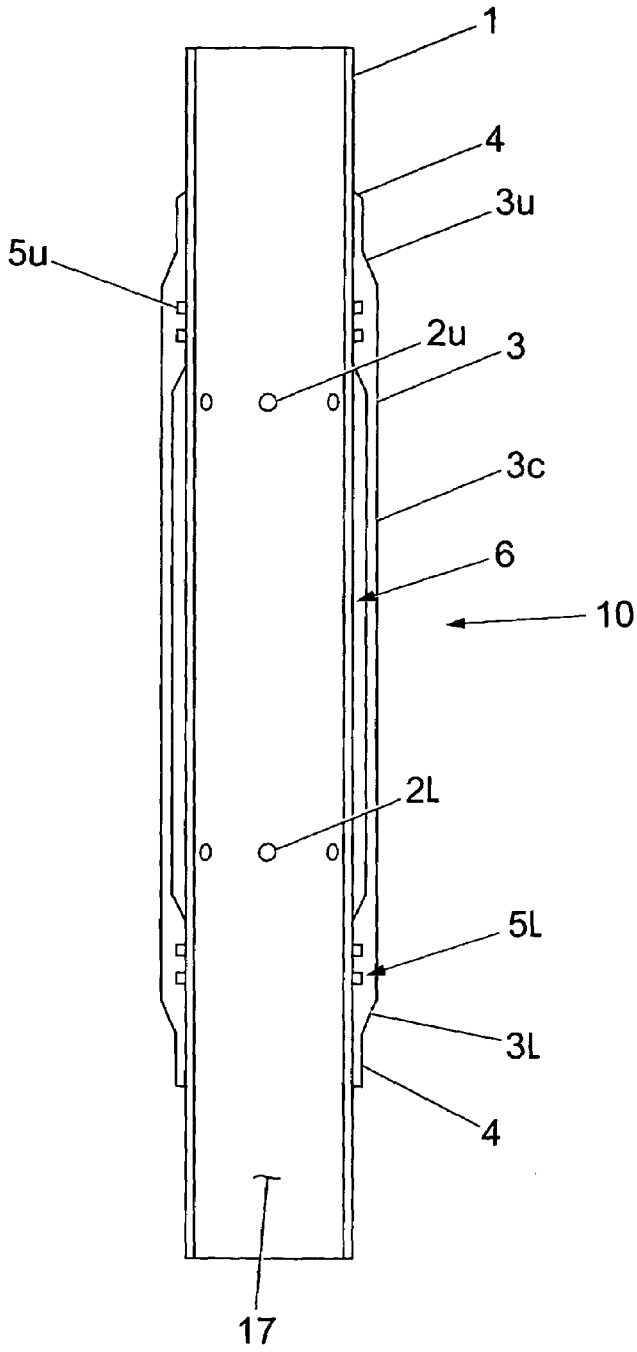
FIG. 1 is a cross-sectional view of a first embodiment of a casing section with surrounding sleeve welded thereto.

FIG. 1 shows an apparatus 10 in accordance with the present invention. A casing is generally designated at 1 and provided with two sets of circumferential equispaced holes through its sidewall; upper ports 2*u* and lower ports 2L. However, it should be noted that casing 1 could be modified by only providing one set of ports 2 which could be located at the middle of the length of the casing 1, and furthermore could be modified by only providing one such port 2. Casing 1 is located coaxially within sleeve 3. The casing 1 may be either especially manufactured or alternatively is preferably conventional steel casing with ports 2 formed therein. The sleeve 3 is typically 316L grade steel but could be any other suitable grade of steel or any other metal material or any other suitable material.

The apparatus 10 comprises a sleeve 3 which is a steel cylinder with tapered upper and lower ends 3*u* and 3L and an outwardly waisted central section 3*c* having a relatively thin sidewall thickness. Sleeve 3 circumferentially surrounds casing 1 and is attached thereto at its upper end 3*u* and lower end 3L, via pressure-tight welded connections 4.

Since the central section of sleeve 3 is waisted outwardly and is stood off from the casing 1, this portion of the sleeve 3 is not in direct contact with the exterior of the casing 1 which it surrounds. The inner surface of the outwardly waisted section 3*c* of sleeve and the exterior of the casing 1 define a chamber 6.

Upper O-ring seals 5*u* are also provided towards the upper end of sleeve 3*u* but interior of the upper welded connection 4. Similarly lower seals 5L are positioned towards the lower end of sleeve 3L but are also positioned interior of the lower welded connections. Seals 5*u* and 5L are in direct contact with the exterior of the casing and the ends of the sleeve, 3*u* and 3L thereby providing a pressure tight connection between the interior of sleeve 3 and the exterior of casing 1 and thus act as a secondary seal or backup to the seal provided by the welded connections 4.

Ports 2*u* and 21 permit fluid communication between the interior or throughbore of casing 1 and chamber 6.

Figure 2:
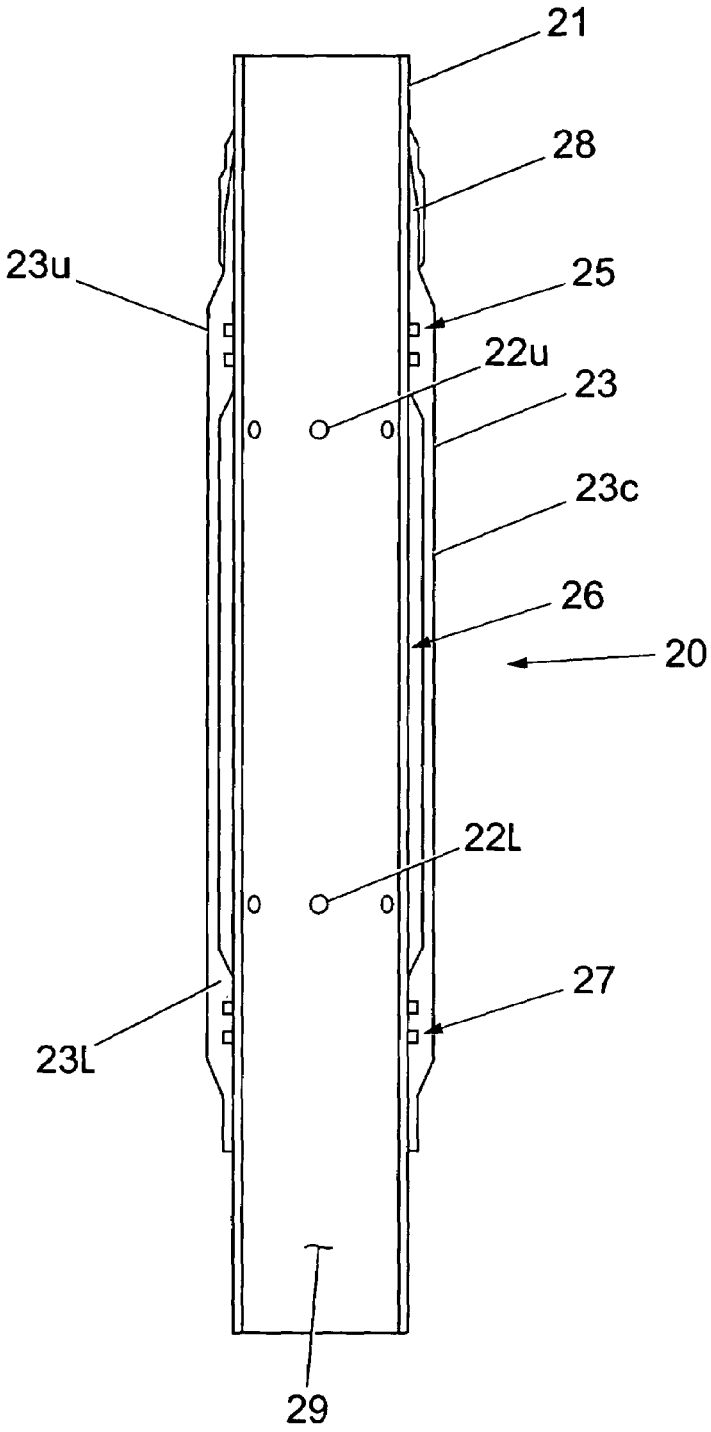
FIG. 2 is a cross-sectional view of a second embodiment of a casing section with an outer sleeve mechanically clamped thereto at one end and a sliding seal provided at the other end.

A second embodiment of an apparatus 20 in accordance with the present invention is shown in FIG. 2 and comprises a sleeve 23 which is substantially cylindrical in shape with upper and lower ends 23*u*, 23L and an outwardly waisted central section and is arranged co-axially around casing 21 which is similar to casing 1 of FIG. 1. Sleeve 23 is secured at its upper end 23*u* to the casing 21 by means of a mechanical clamp 28. Towards the upper end 23*u* of the sleeve, a pair of seal members 25 are also provided in the form of O-rings to provide a pressure tight connection between the upper end of the sleeve 23*u* and the exterior of the casing 21. Sleeve 23 has a lower end 23L which is provided with a pair of sliding O-ring seals 27.

The exterior of the casing 21 in the region of the seals 25, 27 is preferably prepared by machining to improve the surface condition thereby achieving a more reliable connection between the seals 25, 27 and the exterior of the casing 21.

Upper end 23*u* along with seals 25 and lower end of sleeve 23L along with sliding seals 27, waisted central section of sleeve 23*c* and exterior of casing 21 define a chamber 26. Sidewall of casing 21 is provided with circumferential equispaced ports 22 through its sidewall which permits fluid communication between the interior of casing 21 and the chamber 26.

Chamber 26 can be filled with pressurised fluid such as hydraulic fluid to cause expansion of the waisted central section of the sleeve member 23*c* in the radially outward direction, which causes simultaneous upwards movement of the sliding seals 27, which has the advantage over the first embodiment of the sleeve 3 that the thickness of the sidewall of the outwardly waisted central section 23*c* is not further thinned by the radially outwards expansion. However any such upwards movement should be restricted such that the ports 22L, 22*u* in the sidewall of casing 21 remain within chamber 26.

Figure 3:
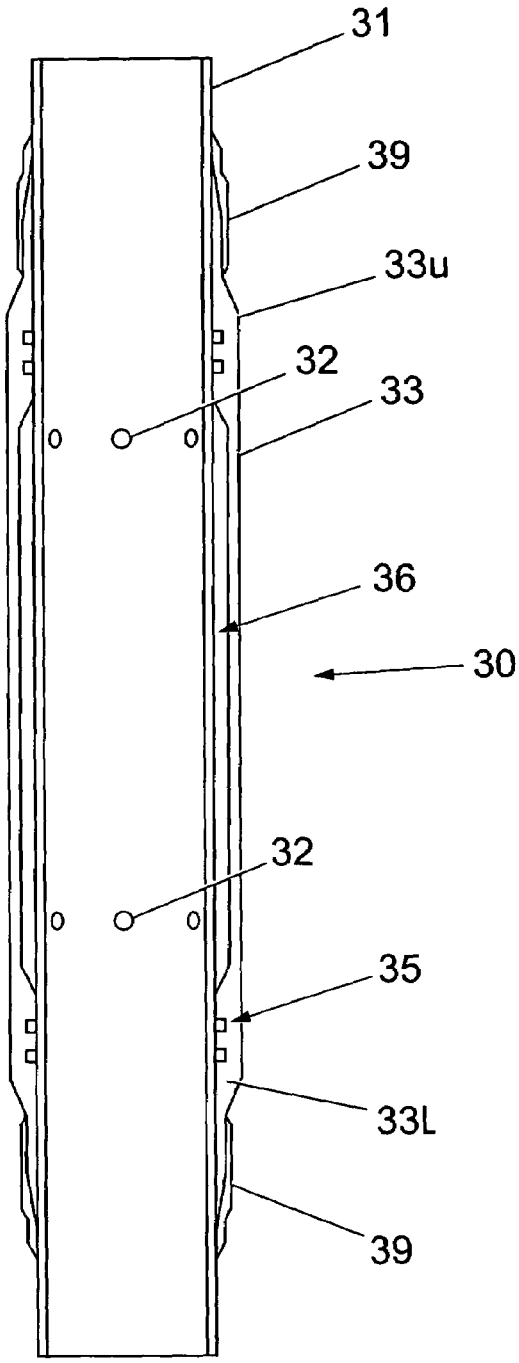
FIG. 3 is a cross-sectional view of a third embodiment of a casing section with an outer sleeve mechanically clamped at both ends.

A further embodiment of apparatus 30 in accordance with the present invention is shown in FIG. 3, where the apparatus 30 is arranged in a similar manner to the apparatus 10, 20 of FIGS. 1 and 2. However, sleeve 33 of FIG. 3 is attached to casing 31 at both the upper end 33*u* and lower end 33L by clamps 39. Clamps 39 are provided to hold the ends of sleeve 33 in position to prevent the sleeve 33 becoming dislodged when the casing 31 is run into the wellbore. Clamp 39 at the upper end 33*u* of the sleeve will allow sleeve 33 to move in a downward direction enabling expansion thereof. However upwards movement of the upper end 33*u* is prevented by clamp 39 which acts as an impediment. Similarly, clamp 39 at the lower sleeve end 33L prevents downward movement, but will permit the lower sleeve end 33L to move upwardly. The clamps 39 also ensure that the sleeve 33 maintains the correct position in relation to the ports 32. Additionally, the clamps 39 maintain the sleeve in position over a section of casing 31 with prepared external surfaces. The surfaces can be prepared by machining and optimise the effectiveness of the two pairs of seals 35.

Ports 2*u* and 21 permit fluid communication between the interior or throughbore 17 of casing 1 and chamber 6.

Casing or liner 41 is located coaxially within sleeve 43 which comprises an inwardly waisted central section 43*c* having a relatively thin sidewall thickness, such that the central section 43*c* is either in contact with, or is close to contact with the outer circumference of the casing 41. However, each end 43*u*, 43L of the central section 43*c* is bowed outwardly in order to provide scope for hydraulic expansion of the sleeve 43 as will be subsequently described; furthermore, this arrangement provides a number of further advantages including reducing the outer diameter of the apparatus which eases running in of the apparatus into the borehole 79 and also provides a radial space within which a compliant material/sealant 75 and outer thin sleeve 77 is provided.

Accordingly, the inner surface of the initially inwardly waisted section 43*c*, the inner surfaces of the bowed out ends 43*u*, 43L and the exterior of the casing/liner 41 define a chamber 46. Port(s) 42 permit fluid communication between the interior or throughbore of the casing/liner 41 and chamber 46.

Upper end 23*u* along with seals 25 and lower end of sleeve 23L along with sliding seals 27, waisted central section of sleeve 23*c* and exterior of casing 21 define a chamber 26. Sidewall of casing 21 is provided with circumferential equispaced ports 22 through its sidewall which permits fluid communication between the interior 29 of casing 21 and the chamber 26.

Figure 7:
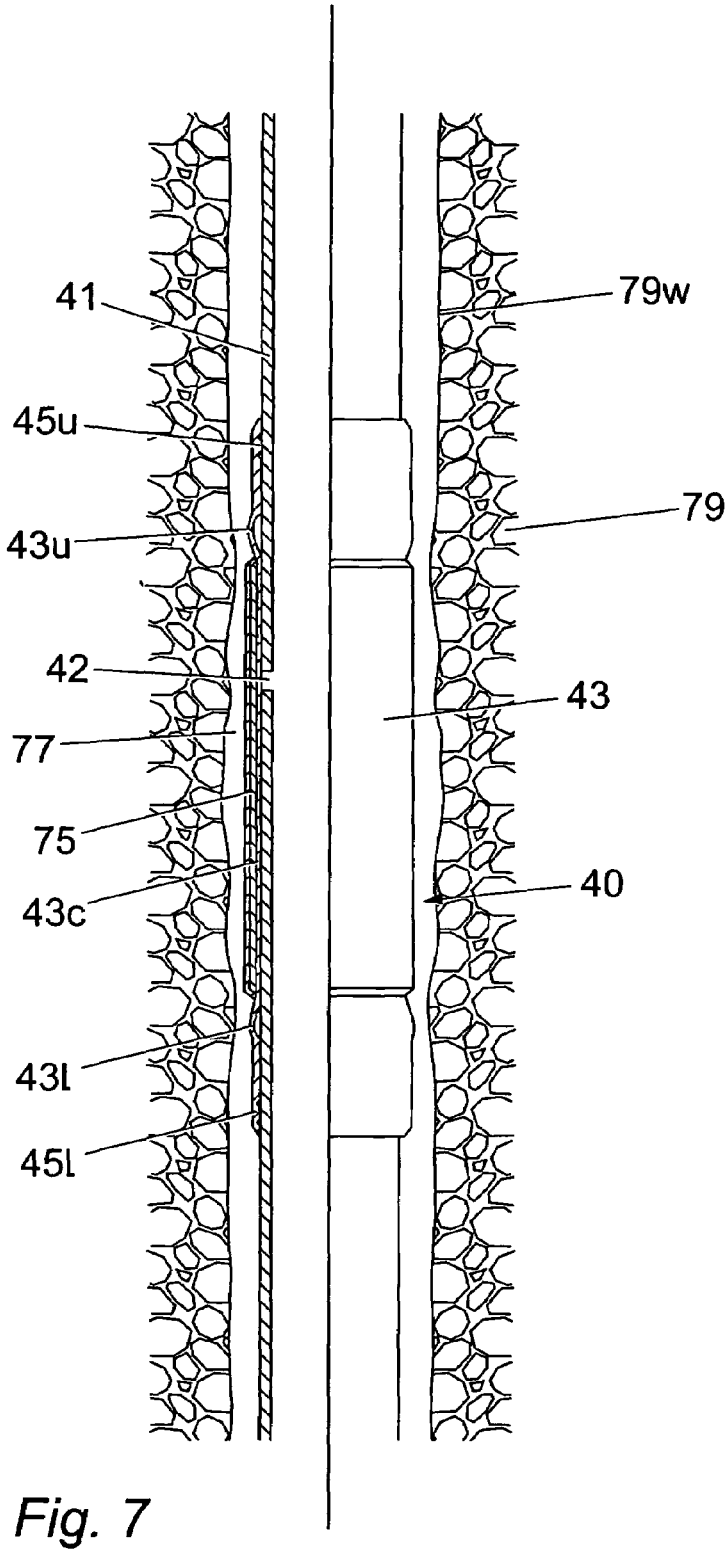
FIG. 7 is a half-cross-sectional view of a portion of a perforated liner or casing provided with a fourth embodiment of an outer sleeve member and being located in a borehole just prior to actuation by a hydraulic expansion tool (not shown)
Figure 8:
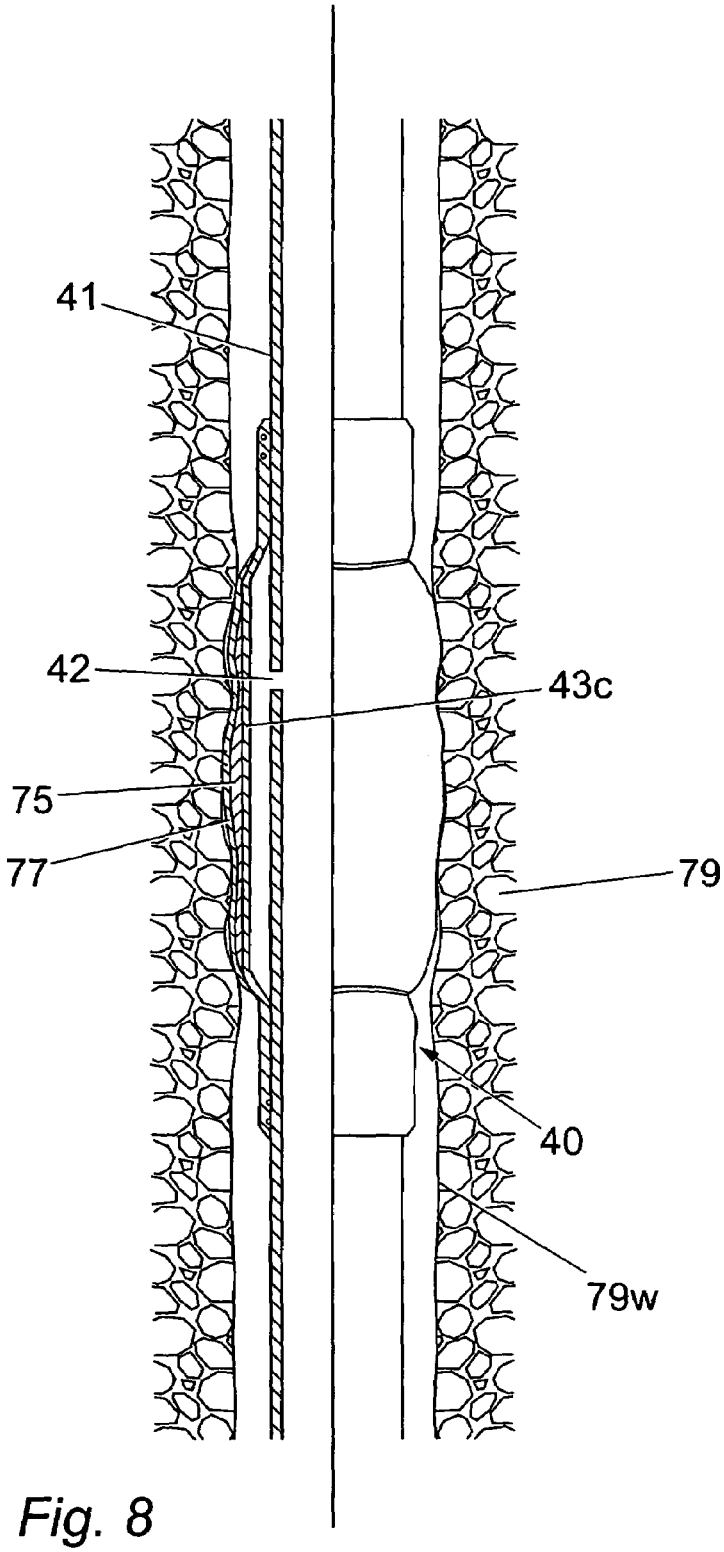
FIG. 8 is a half-cross-sectional view of the sleeve member of FIG. 7 in contact with the borehole wall after actuation by the hydraulic expansion tool.
Figures 9A, 9B:
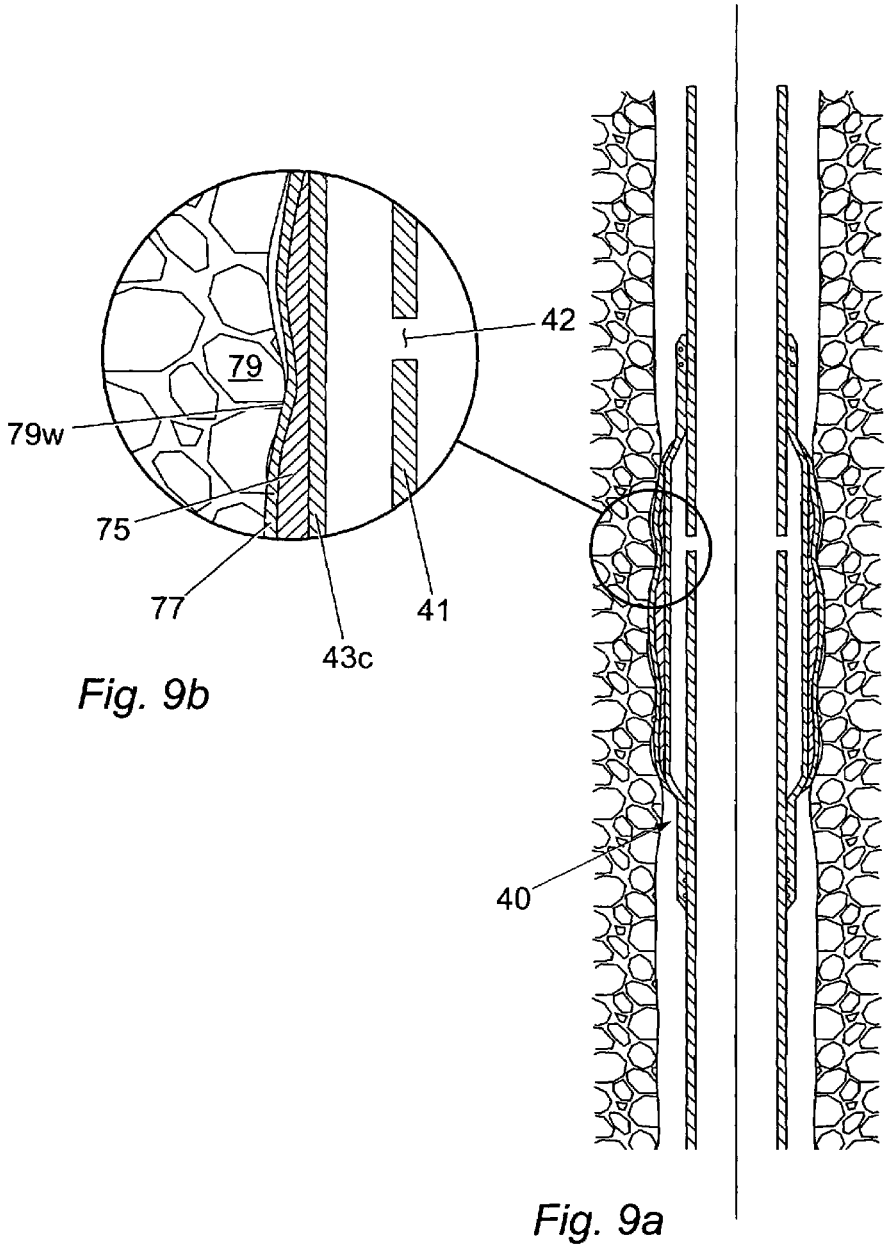
FIG. 9*a* is a full-cross-sectional view of the sleeve member of FIG. 8.
FIG. 9*b* is a detailed view of a portion of the sleeve member of FIG. 9*a;*

However, the apparatus 40 of FIG. 7 comprises a further enhancement over the previously described embodiments in that a compliant material/sealant 75 placed around the expandable diameter of the central section of the outer sleeve 43*c*. A further concentric sleeve 77 formed of thin metal construction (approximately 1-2 mm in thickness) is placed around the compliant material/sealant 75 to effectively sandwich the compliant material/sealant 75 between the existing outer sleeve 43*c* and the thin metal sleeve 77. The thin metal sleeve 77 can be seal welded or clamped to the outer sleeve 43*c* at each end to provide a closed envelope or closed chamber for the compliant material/sealant 75 within.

A further embodiment of apparatus 30 in accordance with the present invention is shown in FIG. 3, where the apparatus 30 is arranged in a similar manner to the apparatus 10, 20 of FIGS. 1 and 2, where the apparatus 30 has chamber 36. However, sleeve 33 of FIG. 3 is attached to casing 31 at both the upper end 33*u* and lower end 33L by clamps 39. Clamps 39 are provided to hold the ends of sleeve 33 in position to prevent the sleeve 33 becoming dislodged when the casing 31 is run into the wellbore. Clamp 39 at the upper end 33*u* of the sleeve will allow sleeve 33 to move in a downward direction enabling expansion thereof. However upwards movement of the upper end 33*u* is prevented by clamp 39 which acts as an impediment. Similarly, clamp 39 at the lower sleeve end 33L prevents downward movement, but will permit the lower sleeve end 33L to move upwardly. The clamps 39 also ensure that the sleeve 33 maintains the correct position in relation to the ports 32. Additionally, the clamps 39 maintain the sleeve in position over a section of casing 31 with prepared external surfaces. The surfaces can be prepared by machining and optimise the effectiveness of the two pairs of seals 35.

The material for the compliant material/sealant 75 is required to be sufficiently viscous to withstand removal and/or erosion from any fluid bypass during the hydraulic expansion of the outer sleeve 43*c* and resulting creation of the isolation barrier (which will be described subsequently). Preferably, the compliant material/sealant 75 will stiffen and set when extruded into, and exposed to, wellbore fluid temperatures. A suitable material 75 may be unvulcanised (green) elastomer which when extruded through small ports undergo a shearing effect, in a manner similar to transfer moulding, which will further promote the setting of the sealant 75. Chemical sealants, adhesives, lost circulation type fluids and specially developed pressure sealing crosslinked polymers are other possible materials 75.

Isolation barrier apparatus 10, 20, or 30 is conveyed into the liner or borehole by any suitable means, such as incorporating the apparatus into a casing or liner string and running the string into the wellbore until it reaches the location within the liner or borehole at which operation of the apparatus 10, 20, 30 is intended. This location is normally within the liner or borehole at a position where the sleeve 3, 23, 33 is to be expanded in order to, for example, isolate the section of borehole (or if present, casing/liner) located above the sleeve 3, 23, 33 from that below in order to provide zonal isolation.

Figure 4:
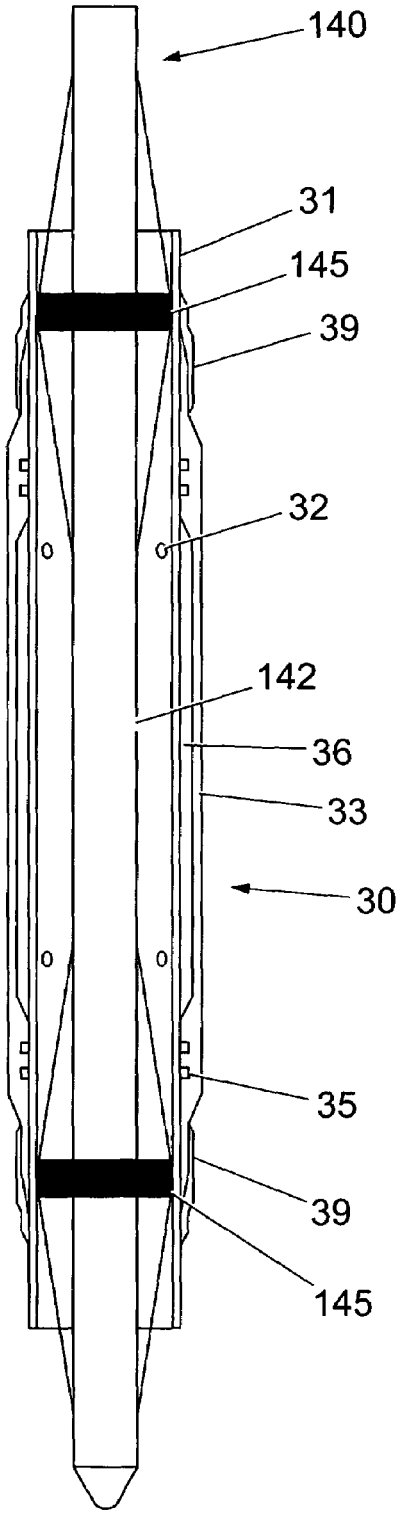
FIG. 4 is a cross-sectional view of the casing section and attached outer sleeve of FIG. 3 and an hydraulic expansion tool therein.

Expansion of the sleeve member 3, 23, 33 can be effected by a hydraulic expansion tool such as that shown in FIG. 4. FIG. 4 shows tool 140 inserted into the casing section 31 shown in FIG. 3. Once the casing 31 reaches its intended location, tool 140 can be run into the casing string from surface by means of a drillpipe string or other suitable method. The tool 140 is provided with upper and lower seal means 145, which are operable to radially expand to seal against the inner surface of the casing section 31 at a pair of spaced apart locations in order to isolate an internal portion of casing 31 located between the seals 145; it should be noted that said isolated portion includes the fluid ports 32. Tool 140 is also provided with an aperture 142 in fluid communication with the interior of the casing 31.

To operate the tool 140, seal means 145 are actuated from the surface (in a situation where drillpipe or coiled tubing is used) to isolate the portion of casing. Fluid, which may be hydraulic fluid, is then pumped under pressure through the coiled tubing or drillpipe such that the pressurised fluid flows through tool aperture 142 and then via ports 32 into chamber 36.

A detailed description of the operation of such an expander tool 140 is described in UK Patent application no. GB0403082.1 (now published under UK Patent Publication number GB2398312) in relation to the packer tool 112 shown in FIG. 27 with suitable modifications thereto, where the seal means 145 could be provided by suitably modified seal assemblies 214, 215 of GB0403082.1, the disclosure of which is incorporated herein by reference. The entire disclosure of GB0403082.1 is incorporated herein by reference.

Figure 10:
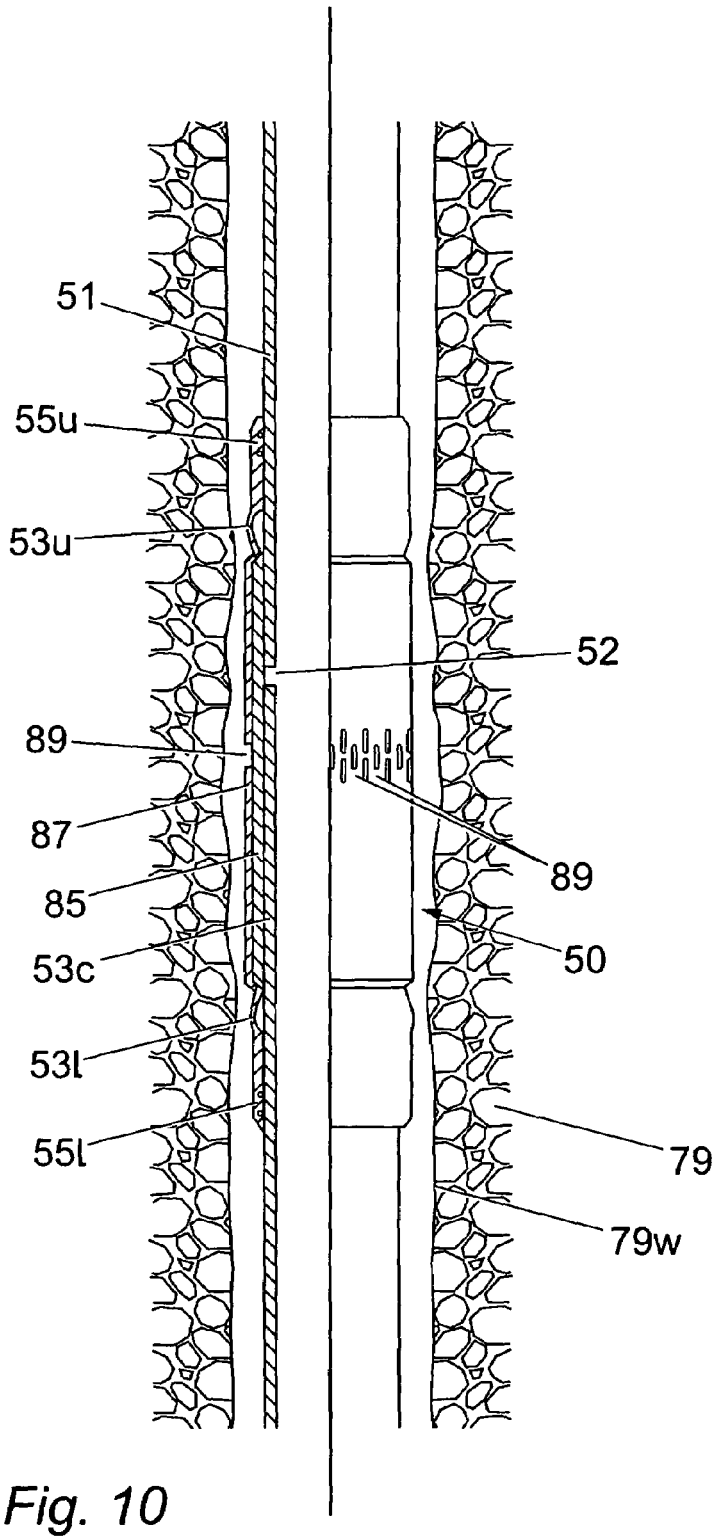
FIG. 10 is a half-cross-sectional view of a portion of a liner or casing provided with a fifth embodiment of a perforated outer sleeve member and being located in a borehole just prior to actuation by a hydraulic expansion tool (not shown)
Figure 11:
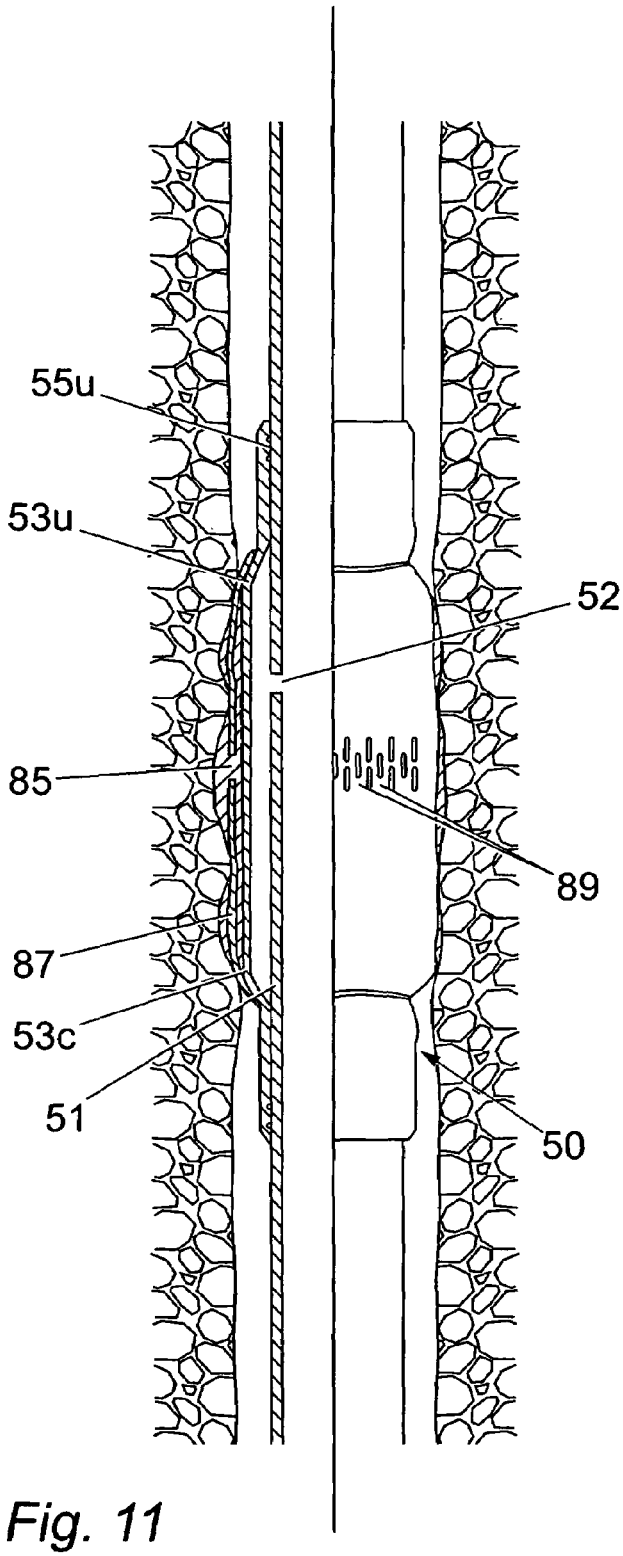
FIG. 11 is a half-cross-sectional view of the sleeve member of FIG. 10 in contact with the borehole wall after actuation by the hydraulic expansion tool.
Figures 12A, 12B:
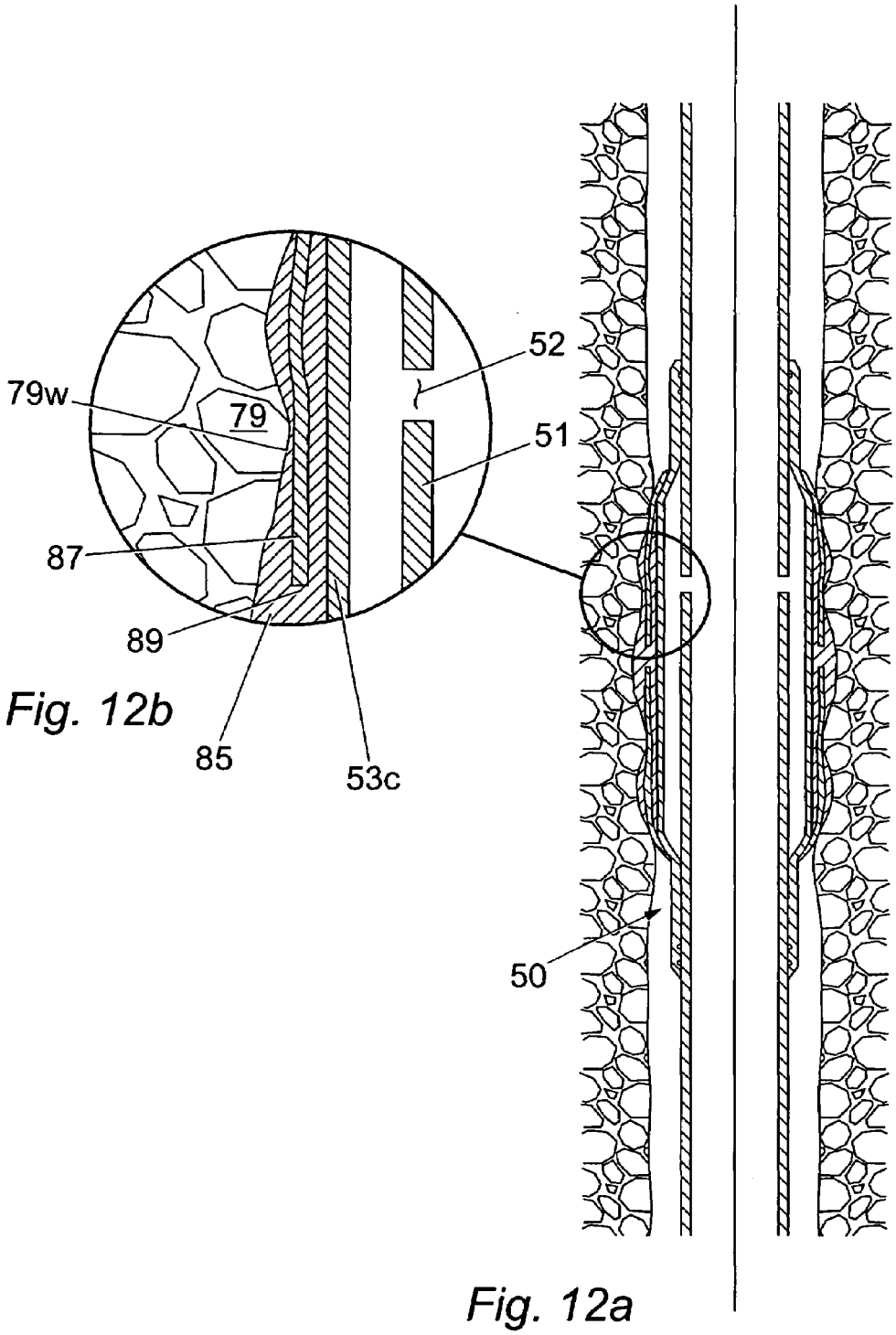
FIG. 12*a* is a full-cross-sectional view of the sleeve member of FIG. 10.
FIG. 12*b* is a detailed view of a portion of the sleeve member of FIG. 12*a*.

FIG. 10 shows a yet further enhanced isolation barrier apparatus 50 and which is identical to the apparatus 40 of FIG. 7 and components of the apparatus 50 which are similar to components of the apparatus 40 are denoted with the reference numeral pre-fix 5- instead of 4-. Accordingly, FIG. 10 shows casing or liner 51, port 52, upper 53*u* and lower 53L bowed out ends and upper 55*u* and lower 55L O-ring seals. However, the apparatus 50 differs from apparatus 40 by the addition of holes or perforations 89 provided around the circumference of, and through the sidewall of, the thin metal sleeve 87 to permit the compliant material/sealant 85 to be extruded through such holes or perforations 89 when the sleeves 53*c*, 87 are forced against the borehole wall 79*w* as a result of the hydraulic expansion of the outer sleeve 53*c*, as will be subsequently described. Furthermore, the compliant material 85 used in this embodiment 50 is specifically formulated to act as a sealant.

Alternatively the increase of pressure within chambers 6, 26, 36, can be maintained such that the sleeve 3, 23, 33 continues to move outwardly against the adjacent pipe, casing or liner section such that the adjacent casing or liner section or pipe starts to experience elastic expansion. As the sleeve 3, 23, 33 makes contact with the tubular member or pipe, the pressure increases due to the resilience of the tubular member or pipe wall until the tubular member or pipe wall undergoes elastic deformation typically in the region of up to half a percent. The increase in setting pressure can be continued until a desired level of plastic expansion of the sleeves 3, 23, 33 have occurred and with the adjacent tubular member or pipe having undergone elastic expansion, when the pressure of the fluid is reduced the tubular member or pipe will maintain a compressive force inwardly on the plastically expanded sleeve 3, 23, 33.

When the tubular member or pipe has undergone elastic deformation, pressure can be released. In this situation, sleeves 3, 23, 33 are securely held since they have undergone plastic deformation with the tubular member remaining elastically deformed.

Figure 5:
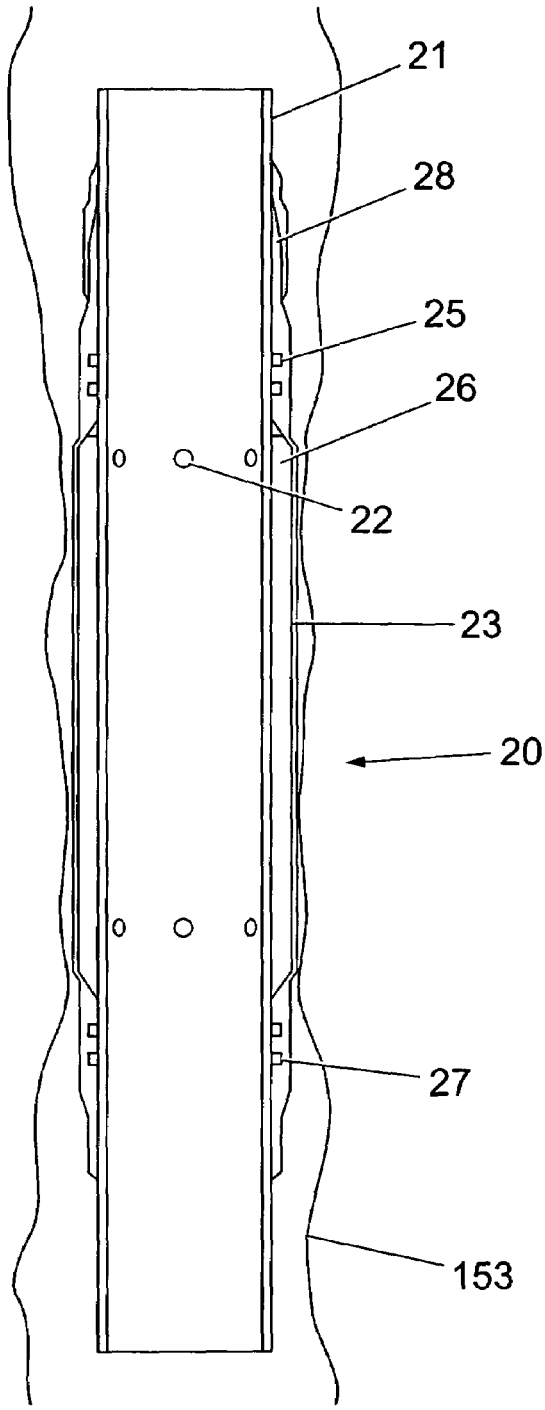
FIG. 5 is a cross-sectional view of the casing section of FIG. 2 and expanded outer sleeve in contact with a borehole wall.

FIG. 5 shows the casing 21 of FIG. 2 with sleeve 22 in its expanded configuration, bearing against the borehole wall 153. Chamber 26 is filled with pressurised fluid which is prevented from exiting the chamber 26 by means of optional check valves (not shown) attached to ports 22 to maintain the sleeve 23 in an expanded condition; the check valves permit the flow of pressurised fluid from the throughbore 17, 29 into the chamber 6, 26 but prevent the flow of fluid in the reverse direction.

Pressurised chemical fluid can be pumped into chamber 26 to expand sleeve 22. Once expanded the sleeve 22 may be maintained in position by check valves or the chemical fluid can be selected such that it sets in place after a certain period of time.

Alternatively, the ports 22 may be provided with a burst disks (not shown) therein, which will prevent fluid flow through the ports 22 until an operator intentionally ruptures the disks by applying hydraulic fluid pressure from the throughbore 17, 29 to the inner face of the disk until the pressure is greater than the rated strength of the disk.

FIG. 6 shows a sequence for expanding two sleeve members. Different formations are indicated by reference numerals 180*a-e*.

Figures 6A, 6B, 6C:
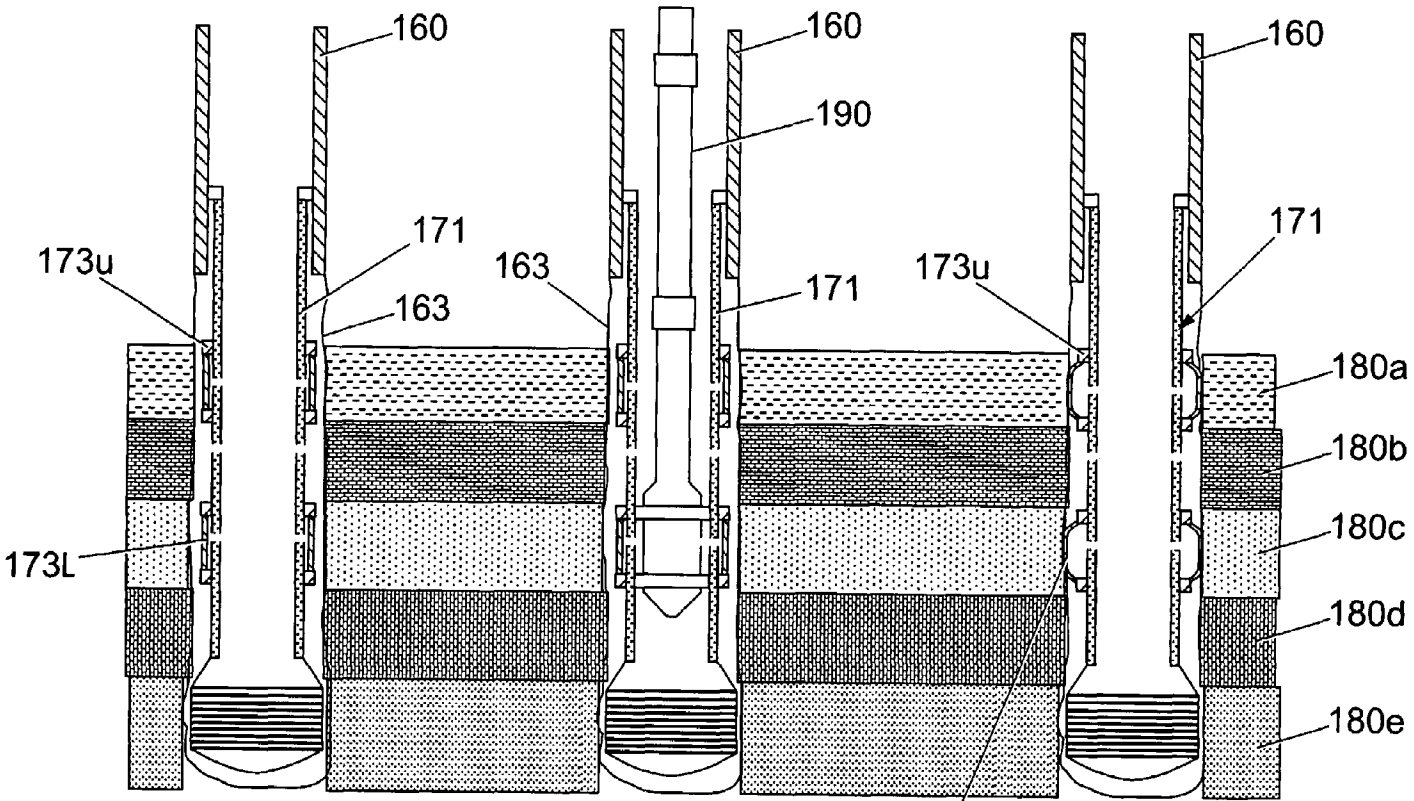
FIG. 6*a* is a cross-sectional view of a perforated liner provided with two sleeve members.
FIG. 6*b* shows the perforated liner in a borehole of FIG. 6*a* with a hydraulic expansion tool inserted therein.
FIG. 6*c* is a cross-sectional view of the perforated liner of FIGS. 6*a* and 6*b* with expanded sleeves.

FIG. 6*a* shows the embodiment where a perforated liner/casing 171 is attached at its upper end by any suitable means such as a liner hanger to the lower end of a cemented casing 160. Liner 171 is provided with two sleeves 173*u*, 173L sealed thereto and similar to those previously described.

FIG. 6*b* shows the perforated liner 171 of FIG. 6*a* in a borehole 163 with a hydraulic expansion tool 190 inserted therein.

Activation of the hydraulic expansion tool 190 increases the pressure in the chambers defined by the sleeves 173 such that the sleeves expand outwardly as shown in FIG. 6*c*. Thus, the sleeves 173*u*, 173L isolate formation 180*b* (which may be a hydrocarbon producing zone) from the zones above and below 180*a*, 180*c* to 180*e* (which may be, for example water producing zones) and thus provide a means of achieving zonal isolation.

As shown in FIG. 7, the apparatus 40 complete with the additional compliant material 75 sandwiched between the thin metal sleeve 77 on the outside and the outer (outer to the casing 41) sleeve 43*c* is run into position in the open hole section 79 to be isolated in the same manner as the previously described embodiments 10, 20 and 30. The hydraulic expansion tool (not shown in FIGS. 7 to 9*b*) is run into the well through the casing 41 bore in the same manner as the previously described embodiments 10, 20 and 30, and the outer sleeve 43*c* is pressured up via the communication port 42 as previously described for the other embodiments. In this case however, when the outer sleeve 43*c* expands, both the compliant material 75 and thin metal sleeve 77 will be forced to move outwardly along with the outer sleeve 43*c* and will be forced into contact with the open hole 79. As the thin metal sleeve 77 contacts the inner wall 79 of the open hole 79 it will conform to the irregularities of the borehole wall 79*w*, since the compliant material 75 beneath it takes up the annular variances between the less compliant outer sleeve 43*c* and the more compliant thin metal sleeve 77. As the volume of compliant material 75 remains unchanged once all irregularities are filled, the contact stresses between the thin metal sleeve 77 and the wall 79*w* will increase as the activating pressure provided by the hydraulic expansion tool is increased. This has the advantage of providing a metal to open hole seal that conforms more closely to the borehole wall 79*w* variations than the bare outer sleeve 43*c*, the overall effect of which should improve the effectiveness of the isolation barrier apparatus 40.

The apparatus 50 is run into position in the same manner as the previously described embodiments 10, 20, 30 and 40.

When the outer sleeve 53*c* is pressured up in the same manner as previously described, the thin metal sleeve 87 is once again forced against the borehole wall 79*w*. As this happens, the annular volume between the thin metal sleeve 87 and the outer sleeve 53*c* will decrease, which causes the compliant material/sealant 85 to be extruded out through the holes/perforations 89 in the thin metal sleeve 87 and to be squeezed into the remaining annular space between the thin metal sleeve 87 and the borehole wall 79*w*. In this way, any deep irregularities in the borehole wall 79*w* can be filled with the compliant material/sealant 85. As the sealant 85 sets or cures, it should create a more effective fluid seal and hence an improved isolation barrier can be achieved.

Modifications and improvements may be made to the embodiments hereinbefore described without departing from the scope of the invention.

I claim:

1. An assembly comprising:

a tubular section arranged to be run into and secured within a larger diameter generally cylindrical structure;

at least one sleeve member wherein the sleeve member is positioned on the exterior of the tubular section and sealed thereto; and pressure control means operable to alter the pressure within the sleeve member such that an increase in pressure causes the sleeve member to move outwardly and bear against an inner surface of the larger diameter structure;

wherein a portion of the sleeve member is enveloped by a further outer sleeve member and a compliant/sealing material is located between the outer surface of said sleeve member and the inner surface of said further outer sleeve member;

wherein the further outer sleeve member comprises apertures formed through its sidewall and through which the compliant/sealing material is capable of being extruded when the pressure control means is operated to move said sleeve member outwardly.

2. An assembly according to claim 1, wherein the tubular section is located coaxially within the sleeve member, and the tubular section and sleeve are adapted to be run into an open or cased oil, gas or water well.

3. An assembly according to claim 1, wherein the assembly comprises a pair of seal mechanisms to provide a pressure tight seal between the outer surface of the tubular section and the inner surface of both ends of the sleeve member, wherein a chamber is created, defined by the outer surface of the tubular section, the inner surface of the sleeve member and an inner face of each seal mechanism.

4. An assembly according to claim 3, wherein the tubular section comprises at least one port formed through its sidewall, and wherein the sleeve member is located on the outer surface of the tubular section such that the port is interposed between each of the seal mechanisms such that pressurised fluid forced through the port, from the throughbore of the tubular section, is retained within the chamber.

5. An assembly according to claim 4, wherein the pressure control means comprise a hydraulic tool having at least one fluid outlet aperture, the hydraulic tool being capable of being run into the throughbore of the tubular section and delivering pressurised fluid through the fluid outlet aperture and through the at least one port in the tubular member into the said chamber.

6. An assembly according to claim 5, wherein the hydraulic tool comprises a pair of seal means arranged to seal the throughbore of the tubular section at a location above the port and at a location below the port, such that pressurised fluid exiting the outlet aperture in the hydraulic tool is forced to flow through the port in the tubular section and into the chamber formed by the sleeve member.

7. An assembly according to claim 5, wherein pressure within the sleeve member is capable of being increased such that the sleeve member expands and contacts the outer casing or borehole wall, until sufficient contact pressure is achieved resulting in a pressure seal between the exterior of the sleeve member and the inner surface of the casing or borehole wall against which the sleeve member bears, in order to prevent or reduce flow of fluids in the borehole annulus from one side of the sleeve member to the other.

8. An assembly according to claim 1, wherein the seal mechanisms provided at each end of the sleeve member comprise sliding seals which act between the interior of the sleeve member and exterior of the tubular section and permit movement in a longitudinal direction to shorten the distance between the ends of the sleeve member such that outward movement of the sleeve member avoids excessive thinning of the sleeve member.

9. An assembly according to claim 1, wherein a plurality of sleeve members are positioned on the exterior of the tubular section and are sealed thereto about respective ports and are operable to isolate separate hydrocarbon zones from one another.

10. An assembly according to claim 1, wherein the tubular section is a casing tubular and comprises one or more perforations formed in a sidewall thereof, wherein sleeve members are located either side of a perforation in the casing tubular and are expanded to permit fluid from the well to enter the casing through the perforations, with the expandable sleeve members acting as an impediment to prevent fluid from entering different annular zones.

11. An assembly according to claim 1, wherein the said sleeve member is a unitary component and is also formed entirely from steel.

* * * * *